US012173467B2

(12) United States Patent
Friedrich

(10) Patent No.: US 12,173,467 B2
(45) Date of Patent: Dec. 24, 2024

(54) QUICK-HITCH FOR CONSTRUCTION VEHICLE TOOLS

(71) Applicant: Kinshofer GmbH, Holzkirchen (DE)

(72) Inventor: Thomas Friedrich, Schliersee (DE)

(73) Assignee: Kinshofer GmbH, Holzkirchen (DE)

( * ) Notice: Subject to any disclaimer, the term of this patent is extended or adjusted under 35 U.S.C. 154(b) by 694 days.

(21) Appl. No.: 17/493,217

(22) Filed: Oct. 4, 2021

(65) Prior Publication Data

US 2022/0106762 A1 Apr. 7, 2022

(30) Foreign Application Priority Data

Oct. 5, 2020 (DE) ..... 202020105697.2
Mar. 2, 2021 (DE) ..... 202021101016.9

(51) Int. Cl.
*E02F 3/36* (2006.01)

(52) U.S. Cl.
CPC ..... *E02F 3/3663* (2013.01); *E02F 3/3618* (2013.01)

(58) Field of Classification Search
CPC ..... E02F 3/3663; E02F 3/3618; E02F 3/3622; E02F 3/365; E02F 3/3627
See application file for complete search history.

(56) References Cited

U.S. PATENT DOCUMENTS 5,494,396 A * 2/1996 Geier ..... E02F 3/364 37/468
5,549,440 A * 8/1996 Cholakon ..... E02F 3/3663 37/468
7,306,395 B2 * 12/2007 Fatemi ..... E02F 3/365 403/321
9,382,686 B2 * 7/2016 Friedrich ..... E02F 3/3622
9,689,139 B2 * 6/2017 Friedrich ..... E02F 3/3622
2004/0057784 A1 * 3/2004 Geraghty ..... E02F 3/3659 403/322.3

(Continued)

FOREIGN PATENT DOCUMENTS

AU 2013211448 A1 2/2015
DE 9315868 U1 10/1993

(Continued)

OTHER PUBLICATIONS

Office Action from Application No. GB2114074.4 dated Feb. 7, 2022.

(Continued)

*Primary Examiner* — Adam J Behrens
*Assistant Examiner* — Blake E Scoville
(74) *Attorney, Agent, or Firm* — Troutman Pepper Hamilton Sanders LLP; Ryan A. Schneider; Matthew J. Esserman

(57) ABSTRACT

A quick-hitch for coupling a tool to an excavator arm or to a similar tool manipulator, including two hitch halves that can be latched together and that comprise at least one pair of latching parts with which a displaceable latch is associated, an actuating cylinder being provided for actuating the latch. The actuating cylinder has a mechanical blocking unit for locking the latching position of the bolt, having a lead screw which is in a threaded engagement with the piston and/or the piston rod of the actuating cylinder, so that the piston is only displaceable by turning the lead screw, as well as a releasable anti-rotation device for the lead screw.

20 Claims, 8 Drawing Sheets

(56) References Cited

U.S. PATENT DOCUMENTS

| | | | | |
|---|---|---|---|---|
| 2011/0020102 | A1* | 1/2011 | Yrjo | E02F 3/3677 414/723 |
| 2015/0259874 | A1* | 9/2015 | Cunningham | E02F 3/3672 74/89.39 |
| 2017/0067223 | A1* | 3/2017 | Tsukada | E02F 3/3622 |
| 2017/0233978 | A1* | 8/2017 | Friedrich | E02F 3/3663 403/14 |

FOREIGN PATENT DOCUMENTS

| | | | |
|---|---|---|---|
| DE | 202014001328 | U1 | 5/2015 |
| EP | 1852555 | A2 | 11/2007 |
| FR | 2939159 | A1 | 12/2008 |
| GB | 2505703 | A | 3/2014 |

OTHER PUBLICATIONS

Extended European Search Report from Application DE 20 2021 101 016.9 dated Dec. 15, 2021.

* cited by examiner

QUICK-HITCH FOR CONSTRUCTION VEHICLE TOOLS

CROSS-REFERENCE TO RELATED APPLICATIONS

This application claims the benefit of DE Patent Application Serial Nos. 20 2020 105 697.2 filed on 5 Oct. 2020 and 20 2021 101 016.9 filed on 2 Mar. 2021, the benefit of the earlier filing dates of which are hereby claimed under 35 USC § 119(a)-(d) and (f). The entire contents and substance of all applications are hereby incorporated by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

SEQUENCE LISTING

Not Applicable

STATEMENT REGARDING PRIOR DISCLOSURES BY THE INVENTOR OR A JOINT INVENTOR

Not Applicable

BACKGROUND OF THE DISCLOSURE

1. Field of the Invention

The present invention relates to a quick-hitch for coupling a tool to an excavator arm or to a similar tool manipulator, comprising two hitch halves that can be latched together and that comprise at least one pair of latching parts with which a retractable and extractable latch is associated, an actuating cylinder being provided for actuating the latch.

2. Description of Related Art

Quick couplings for coupling various tools, such as rakers, clamshell buckets or demolition claws, to an excavator arm or similar tool guides such as articulated arm jibs, are often used on construction vehicles such as hydraulic excavators, or articulated grabbers such as wood handling machines or demolition devices, or similar material handling machines, in order to be able to use different tools without long retooling times.

As latching elements, quick couplings of this kind can in particular comprise two mutually spaced latching shafts on one coupling part, while the other coupling part, in particular the coupling part on the excavator arm side, can comprise a preferably hook-shaped coupling receptacle for hooking in a first of the two latching shafts, and a latching receptacle for latching to the second latching shaft. After the first latching shaft has been hooked into the coupling receptacle, the two coupling parts can be pivoted relative to one another, wherein the latching shaft located in the coupling receptacle forms the axis of rotation, such that the second latching shaft is inserted or pivoted into the latching receptacle, where the second latching shaft can then be latched, for example in the manner of an extensible chock, by means of a latching element, such that it is at the same time also no longer possible to move the first latching shaft out of the coupling receptacle. In order to move the latching element, an adjustment actuator that is actuated by external energy is provided, which actuator can for example be designed as a hydraulic cylinder and is typically actuatable by means of hydraulic pressure, from the device.

In this case, the latching shafts on one of the coupling parts can be formed by latching bolts which can extend on the corresponding coupling part, in particular so as to be mutually parallel, wherein it may also be possible, however, for other structural parts of the coupling part, such as protruding lugs, axle journals, engagement stubs in the form of protrusions or recesses, for example in the form of pockets, to be used as the latching part, instead of such bolts, the shape of which parts is matched to the coupling receptacle or the latching receptacle of the other coupling part.

Quick couplings of this kind are also subject to standards with respect to the dimensions and the latching parts, in order to ensure the compatibility of a coupling half used on the excavator arm with various tools on which a coupling half is mounted and which, depending on the tool, may originate from various manufacturers and should be sufficiently compatible with the arm-side coupling half that the two coupling halves can come together and latch. Standardization of this kind is achieved for example in the form of what is known as the S-coupler or the S-standard, which specifies the dimensions and arrangement of the latching elements and receiving jaws and was specified by the Swedish institute Maskinleverantörerna and was last published on 28 May 2010. The S-coupler comprises, in the manner described above, two mutually parallel transverse bolts as latching parts on one coupling half, while the other coupling half comprises a jaw-like coupling receptacle on one side, and an L-shaped latching receptacle on the other side, on opposing end faces, which receptacles can be locked or closed to form a receptacle which is then also U-shaped or jaw-like, by means of a pair of extractable latching bolts.

Further examples of quick couplings of this kind are known from documents EP 1 852 555 A2, DE 20 2012 007 124 U1 and DE 20 2014 001 328 U1.

The transverse bolt, which is moved into a receiving jaw, is usually secured or fixed there by a latch, which can be actuated by a hydraulic actuating cylinder. In this respect, it is known to bias the latch into the latching position by means of a spring and to use the hydraulic cylinder only for opening, whereas it may also be intended to use the actuating cylinder for both latching and unlatching. In both cases, the latch should be secured in its latching position to reliably prevent unintentional unlatching of the quick-hitch. An option in this case is to latch the actuating cylinder, which is usually achieved hydraulically by shutting off the inlet to the cylinder chamber that drives the actuating cylinder into the latching position by means of a valve, so that the pressure medium in the pressure chamber will no longer be able to escape and thus to move to the latching position. Such hydraulic locking is in itself favorable in terms of the space required on the cylinder, which is significant since the installation space available on the quick-hitch is very limited.

Nevertheless, reliable locking of the latch in the latching position should be ensured even if the hydraulic system of the excavator or the machine to which the quick-hitch is attached fails. Yet such a locking device, which is safe against hydraulic failures, on the one hand needs to take into account the very limited space available on the quick-hitch, and on the other hand, additional components protruding beyond the outer contours of the quick-hitch halves should be avoided as far as possible so as to avoid providing an attack surface during rough construction site operation, which could lead to damage or even breakage of the locking device if it gets caught on stones, brickwork and the like.

On the other hand, the locking mechanism should still be very stable and reliably withstand the high forces acting on the quick-hitch, which in itself precludes a fragile design of the locking components. As the entire working forces acting on the tool, for example the full working loads of a grab bucket plunging into the soil or subsoil, have to be carried away via the two transverse bolts of the quick-hitch, there are concentrated very high forces which, though not acting on the bolt in the direction of the opening movement, still tug at it. Since the bolts are often wedge-shaped in order to force the transverse bolts into the receiving jaws, forces can also be applied to the bolt in the opening direction via the wedge surface.

So proceeding from this, it is therefore the underlying object of the present invention to provide an improved quick-hitch of the initially named kind which avoids disadvantages of the prior art and further develops the latter in an advantageous manner. In particular, a space-saving locking device that can be integrated into the installation space of the quick-hitch is to be created for fixing the latch in the latching position, which withstands high forces and is easy and reliable to operate even under rough operating conditions.

SUMMARY OF THE INVENTION

In an exemplary embodiment of the present invention, a quick-hitch comprises a first hitch half comprising a first latching part, a second hitch half comprising a second latching part, and a latching element actuator configured to actuate a latching element between a latch position where the first hitch half and the second hitch half are latched together, and an unlatched position where the first hitch half and the second hitch half are unlatched, wherein the latching element actuator comprises a blocking device that, upon activation, is configured to block actuation of the latching element actuator.

The latching element actuator can comprise actuator parts selected from the group consisting of a piston, a piston rod, and a combination thereof, and the blocking device comprises a lead screw that is in a threaded engagement with one or more of the actuator parts so that each threadedly engaged actuator part is displaceable only by turning the lead screw.

The quick-hitch can further comprise a releasable anti-rotation device for the lead screw.

The latching element can comprise a bolt configured to be retractable and extractable from one or both of the first latching part and the second latching part by the latching element actuator.

In an exemplary embodiment of the present invention, a quick-hitch for coupling a tool to an excavator arm or a similar tool manipulator comprises two hitch halves that can be latched to one another and comprise at least a pair of latching parts with which a bolt which can be retractable and extractable is associated, an actuating cylinder being provided for actuating the bolt, wherein the actuating cylinder comprises a mechanical blocking device for locking the bolt in the latching position, which blocking device comprises a lead screw which is in a threaded engagement with the piston and/or the piston rod of the actuating cylinder, so that the piston can only be displaceable by turning the lead screw, and also comprises a releasable anti-rotation device for the lead screw.

The anti-rotation device can be arranged within the cylinder of the actuating cylinder, wherein the anti-rotation device and the lead screw are mounted so as to be axially adjustable relative to each other and can be brought into and out of latching engagement by axial adjustment relative to each other.

The anti-rotation device can be mounted on the adjusting cylinder so as to be axially movable but rotationally fixed, and the lead screw is mounted in the adjusting cylinder so as to be rotatable but axially fixed.

The anti-rotation device can comprise a locking ring which extends in a plane transverse to the longitudinal axis of the actuating cylinder and is guided axially movably in the longitudinal direction of the cylinder, fixed in rotation on the cylinder.

The locking ring can have a circumferential contour deviating from the circular shape and is received in an installation space in the interior of the actuating cylinder, which has an inner circumferential wall deviating from the circular shape and adapted in shape to the locking ring, on which the locking ring is guided axially displaceably and is secured against rotation.

The locking ring can have a plurality of latching claws and/or latching recesses distributed in the circumferential direction, which project towards the lead screw and/or are recessed away therefrom.

The anti-rotation device can be configured to lock on one side only in one direction of rotation.

Latching claws can be provided which lock on one side and have flanks which are directed in the circumferential direction towards opposite sides and which are differently formed, wherein in particular latching flanks are perpendicular towards one circumferential direction and have flanks which rise in a wedge shape towards the opposite circumferential direction.

A preloading device can be provided for biasing the anti-rotation device into the latching position, wherein the biasing device preferably comprises a plurality of spring elements which act on the anti-rotation device with axially acting spring forces.

An adjusting device for axially adjusting the anti-rotation device can comprises at least one separate adjusting element which can be driven axially and axially adjusts the anti-rotation device.

The at least one separate adjustment element can comprise a plunger piston received in a bore in a cylinder wall and adjustable by pressurization.

The actuating cylinder can be accommodated in an interior space of a hitch half and be enclosed by hitch walls in the coupled state of the hitch halves.

The hitch halves can be couplable to each other at a first pair of latching parts and have a second pair of latching parts which are engageable and/or lockable by pivoting the hitch halves together about the first pair of latching parts, the latch being associated with the second pair of latching parts.

The two pairs of latching parts can each comprise a receiving jaw, one of the receiving jaws being formed open to a side opposite to the other receiving jaw, and the other receiving jaw being formed open in a circumferential direction on an arc around the first receiving jaw.

The actuating cylinder can be arranged at an acute angle inclined with respect to a plane defined by the two pairs of latching parts, wherein a longitudinal axis of the actuating cylinder passes opposite sides of the two pairs of latching parts.

As discussed, it is proposed to integrate the locking device for fixing the latch in its latching position into the actuating cylinder in order to avoid protruding of additional components beyond the outer contours of the quick-hitch and to benefit from the protected installation position of the actuating cylinder. According to the invention, the actuating cylinder has a mechanical blocking unit for locking the latching position of the bolt, having a lead screw which is in a threaded engagement with the piston and/or the piston rod of the actuating cylinder, so that the piston is only displaceable by turning the lead screw, as well as a releasable anti-rotation device for the lead screw. Due to the implementation through the lead screw, very high locking forces on the bolt can be absorbed by relatively small reaction forces on the anti-rotation device. At the same time, the solid, force transmitting components of the actuating cylinder are used to lock the latch, so that the latch is reliably secured without requiring additional space in the limited installation space on the quick-hitch. The actuating cylinder simultaneously forms the locking device or the mechanical blocking unit and in this respect fulfills a dual function, wherein the actuating cylinder can adjust the latch hydraulically or by means of pressure medium and lock it mechanically.

In further embodiments of the invention, both the lead screw and the anti-rotation device may be arranged inside the cylinder so that the mechanical blocking unit is fully integrated into the actuating cylinder.

In order to be able to release or engage the anti-rotation device, in an advantageous further embodiment of the invention the anti-rotation device can be mounted in a rotationally fixed but axially movable manner, so that the lead screw can be fixed or released by axial adjustment of the anti-rotation device in the longitudinal direction of the cylinder. In principle, the kinematically reversed adjusting of the spindle in the axial, i.e. longitudinal, direction of the piston could be considered as an alternative or additionally in order to engage and disengage the spindle with the anti-rotation device and thereby fix or release it rotationally. By axially adjusting the anti-rotation device and the threaded stem relative to each other, the threaded stem, which is itself rotatably mounted, can be engaged and disengaged with the non-rotatably mounted anti-rotation device.

In an advantageous further embodiment of the invention, however, the lead screw may be mounted so as to be rotatable but axially fixed, while the anti-rotation device is mounted so as to be axially displaceable but rotationally fixed. In this way there can be achieved a clearance-free locking of the latch, whereas provision can be made for a simple adjustment of the anti-rotation part.

In an advantageous further development of the invention, the anti-rotation device may comprise a locking ring or locking plate which may extend at least approximately in a plane transverse to the longitudinal axis of the spindle and may be axially movable in the longitudinal direction of the cylinder, rotationally fixed, in order to engage with and disengage from the lead screw and/or a lead screw head by adjustment in the axial direction.

On the one hand, such a locking ring or locking plate does not add much weight in the axial direction and therefore avoids an increase in the axial length of the actuating cylinder or a reduction in the axial travel for a given axial dimension of the cylinder, whereas on the other hand, the torque required to secure the lead screw against rotation can be well distributed or the forces acting to secure rotation can be introduced in a distributed manner.

The axially displaceable but rotationally fixed mounting of the locking ring or of the anti-rotation element can advantageously take place on the cylinder of the actuating cylinder, wherein, for example, the locking ring or the anti-rotation element can have an outer contour which deviates from the circular shape and the displacement or installation space of the cylinder in which the anti-rotation element is accommodated can have an inner circumferential wall which deviates from the circular shape and on which the locking ring or the anti-rotation element is located. For example, the cylinder of the actuating cylinder may have an approximately rectangular or hexagonal or elliptical or oval installation space for the locking ring or latching element, which may have an outer circumference adapted to be axially displaced but not rotated. Advantageously, the outer circumferential contour of the locking ring can substantially correspond to the inner circumferential contour of the installation space, so that the outer ring can slide along the wall of the installation ring in a guided manner and at the same time is secured against rotation.

As an alternative or in addition to a support against rotation on the inner wall of the cylinder, the anti-rotation element can also be secured against rotation by separate sliding guide profiles located in the interior of the actuating cylinder. For example, provision can be made for guide rods extending in the longitudinal direction of the cylinder, along which there can slide the locking ring or the anti-rotation element with the corresponding recesses. Alternatively or additionally, the locking ring could also have projecting guide pins which can be slidably guided in guide bores, for example in the base of the cylinder head, to allow axial adjustment and prevent rotation.

In further development of the invention, the locking ring or anti-rotation element may comprise latching claws and/or latching recesses facing the lead screw and/or a lead screw head, which may be engaged and disengaged from counter-recesses and/or counter-claws on the lead screw and/or lead screw head by axial adjustment of the anti-rotation element and lead screw relative to each other in the longitudinal direction of the cylinder. Advantageously, a plurality of latching claws may be arranged in an annularly distributed manner so as to be able to engage in claw recesses which are also arranged in an annularly distributed manner.

The anti-rotation device can be designed to lock in opposite directions, or alternatively only in one direction, in particular in such a way that a rotation of the lead screw, which occurs when the actuating cylinder drives the bolt into the latching position, is possible even when the anti-rotation device is in latching engagement and the anti-rotation device reliably locks only an opposite rotation of the lead screw. This type of configuration of the anti-rotation device, locking on one side or in one direction, can be similar to that of ratchet spanners, which, for example, allow a screw to be turned clockwise and then slip through when it is retightened or reset in the counterclockwise direction. Such an anti-rotation device that locks in one direction only ensures that the bolt can be moved by the actuating cylinder in its fully latching position without the risk of the anti-rotation device latching too early.

For example, the latching claws, which may be arranged in an annular distribution, may have flanks of different shapes in the circumferential direction. For example, on one side, provision can be made for flanks that are approximately perpendicular to the direction of rotation, while the counterflanks can be configured as wedge surfaces that can be overrun by the counter-contour of the latching engagement elements.

In further developments of the invention, provision can be made on the locking ring or locking plate for latching claws projecting in the axial direction and/or latching recesses recessed in the axial direction. The counter-contours to this in the form of latching recesses and/or latching claws can also be formed on the lead screw head and/or on the lead screw itself in an axially projecting and/or recessed manner.

Alternatively or additionally, however, provision could also be made for radially projecting latching claws which can enter radial latching recesses which may be open towards an axial side. For example, provision can be made on the locking ring for radially inwardly projecting latching claws or teeth which can enter latching recesses or tooth gaps on the outer circumference of the lead screw, in particular on a spindle shoulder or at the spindle end.

The anti-rotation device can advantageously be actuated by pressure means or hydraulically, in particular axially. For this purpose, the anti-rotation element, for example the locking plate or locking ring, could be configured as a piston and guided axially displaceably in a pressure chamber in the cylinder, so that axial adjustment can be achieved by applying pressure to the chamber in which the locking ring or locking plate is guided displaceably.

Alternatively or additionally, however, the anti-rotation element can also be adjusted by separate pistons, for example plunger pistons. In this case, the anti-rotation device, for example in the form of the locking plate or locking ring, can be accommodated in an axially movable manner, in particular guided in a displaceable manner, in a movement space inside the actuating cylinder. For axial adjustment, provision can advantageously be made for a plurality of actuating elements, for example in the form of the plunger pistons, which can, for example, be guided displaceably in borehole-shaped pressure chambers in order to project more or less far out of the borehole-shaped chambers depending on the pressure medium applied.

Instead of hydraulic actuation, it would also be possible, alternatively or additionally, to adjust the anti-rotation element axially by actuating elements actuated in another way, for example by electromagnetically adjustable actuating elements.

In further embodiments of the invention, a plurality of actuating elements, for example 3 or 4 or even more than 5 actuating elements, may be arranged distributed around the circumference in order to axially adjust the anti-rotation element.

Advantageously, the anti-rotation element may be biased into its latching position, wherein a suitable biasing device may comprise, for example, one or more spring elements which attempt to drive the anti-rotation element into the latching position by spring force. Hydraulic and/or electromagnetic actuation can be used to release the anti-rotation device, which can overcome the spring forces.

The piston and/or piston rod of the actuating cylinder may have a spindle recess into which the lead screw may extend, or which allows the piston and/or piston rod to be driven over the lead screw. In this case, provision can be made on the piston and/or on the piston rod for a thread which is in screw engagement with the thread of the lead screw.

The anti-rotation device can be arranged in the area of a cylinder base which is located at the end of the pressure chamber acting on the piston, wherein this can in particular be the side facing away from the piston rod.

In order to make good use of the installation space available on the quick-hitch halves and to create a secure arrangement, the actuating and locking cylinder can advantageously be accommodated in an interior space of one hitch half between its outer walls, wherein the actuating and locking cylinder can be positioned in particular between two receiving jaws into which the other hitch half can be inserted with transverse bolts or transverse profiles attached thereto.

In this case, the actuating and locking cylinder can advantageously be installed tilted at an angle with respect to a plane which is determined by the transverse bolt axes passing through the receiving jaws. In particular, the inclined actuator and locking cylinder assembly can be so oriented that the cylinder longitudinal axis extends past the two receiving jaws at an acute angle such that the cylinder longitudinal axis passes the top of one receiving jaw and the bottom of the other, or passes on opposite sides of the receiving jaws.

Advantageously, the receiving jaws on the hitch half on which the locking cylinder is provided may be open to different sides, for example, a first receiving jaw having its opening looking away from the second receiving jaw and the second receiving jaw having its opening looking approximately transversely of the plane joining the two receiving jaws. If the quick-hitch half is arranged in such a way that the two receiving jaw lie approximately in a horizontal plane, a receiving jaw then lying on the right can be open to the right, while the left receiving jaw is open downwards, wherein in this case or with this alignment the latch can be displaced approximately horizontally or inclined at an acute angle thereto in order to be able to close the receiving jaw open downwards or to be able to block it to such an extent that a transverse bolt received therein is caught.

Advantageously, the two pairs of latching parts, which may each be formed by a receiving jaw and a bolt part receivable therein, are such that the two hitch halves may be hooked or coupled to each other on a first pair of latching parts and the second pair of latching parts may be moved together or coupled into each other by twisting the two hitch halves about the coupled, first pair of latching parts. The latch then latches the second pair of latching parts in the coupled position.

These and other objects, features and advantages of the present invention will become more apparent upon reading the following specification in conjunction with the accompanying drawing figures.

BRIEF DESCRIPTION OF THE DRAWINGS

The accompanying Figures, which are incorporated in and constitute a part of this specification, illustrate several aspects described below.

FIG. 3A shows the hitch half which is mounted on the excavator arm and on which a coupling carrier is rigidly mounted, and partial view FIG. 3B shows a tool-side hitch half on which a coupling carrier is mounted in a rubber-elastic manner.

DETAIL DESCRIPTION OF THE INVENTION

Figure 1:
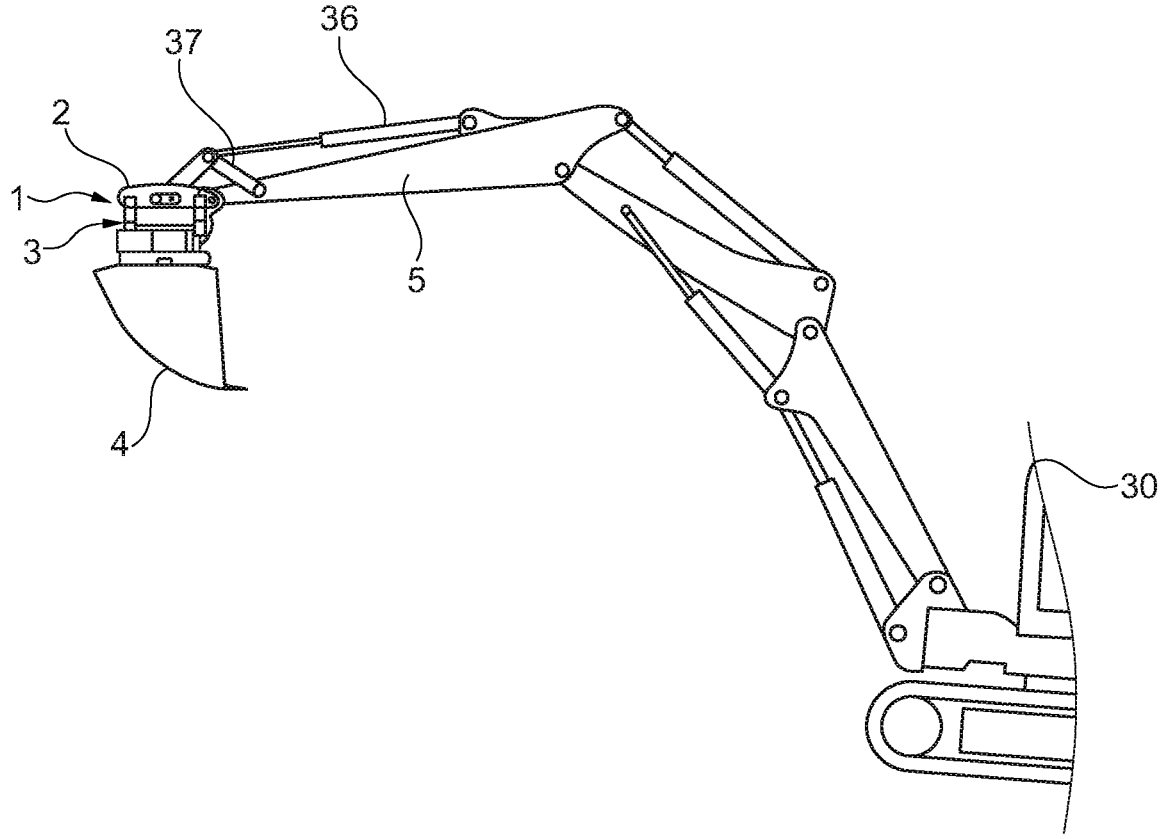
FIG. 1 is a schematic side view of a quick-hitch according to an advantageous embodiment of the invention, which quick-hitch is attached to a jib arm of an excavator and a grab bucket is coupled as an add-on tool.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways.

As used in the specification and the appended Claims, the singular forms "a," "an" and "the" include plural references unless the context clearly dictates otherwise. For example, reference to a component is intended also to include a composition of a plurality of components. References to a composition containing "a" constituent is intended to include other constituents in addition to the one named.

In describing exemplary embodiments, terminology will be resorted to for the sake of clarity. It is intended that each term contemplates its broadest meaning as understood by those skilled in the art and includes all technical equivalents that operate in a similar manner to accomplish a similar purpose.

Ranges may be expressed as from "about" or "approximately" or "substantially" one value and/or to "about" or "approximately" or "substantially" another value. When such a range is expressed, other exemplary embodiments include from the one value and/or to the other value.

Similarly, as used herein, "substantially free" of something, or "substantially pure", and like characterizations, can include both being "at least substantially free" of something, or "at least substantially pure", and being "completely free" of something, or "completely pure".

"Comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

The characteristics described as defining the various elements of the invention are intended to be illustrative and not restrictive. For example, if the characteristic is a material, the material includes many suitable materials that would perform the same or a similar function as the material(s) described herein are intended to be embraced within the scope of the invention. Such other materials not described herein can include, but are not limited to, for example, materials that are developed after the time of the development of the invention.

As shown in FIG. 1, the quick-hitch 1 can be mounted between the free end of the jib arm 5 of an excavator 30 and the add-on tool 4 that is to be attached thereto, wherein the add-on tool 4 can be designed for example as a grab bucket, as is shown in FIG. 1, but which can, in a manner conventional per se, also comprise other construction, handling or demolition tools, for example in the form of clamshell buckets, demolition jaws, pincers, or the like.

In this case, the quick-hitch 1 can be able to be mounted on the jib arm 5, by means of the (arm-side) hitch half 2, so as to be pivotable about a horizontal pivot axis that is oriented transversely to the longitudinal axis of the jib arm 5, such that the quick-hitch 1, together with the add-on tool 4 attached thereto, can be pivoted relative to the jib arm 5 for example by means of a pressure medium cylinder 36 and an interposed pivot piece 37.

A (tool-side) hitch half 3 (cf. FIG. 2) can be attached to the add-on tool 4 and/or an interposed rotary drive.

Figure 2:
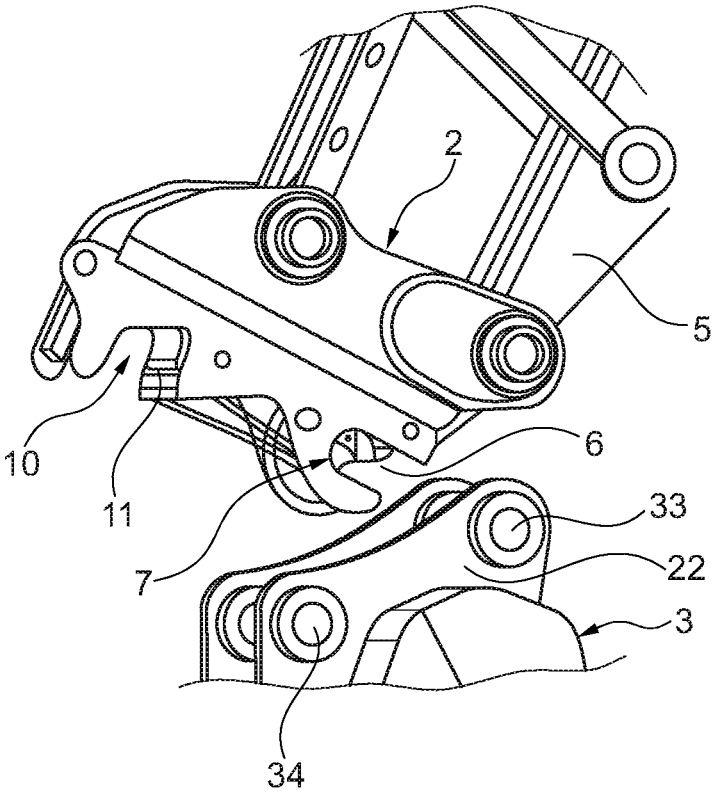
FIG. 2 is a perspective view of the quick-hitch from FIG. 1 in an uncoupled position in which the two hitch halves that can be coupled together are shown shortly before being hooked onto the hook portion.
Figure 3A:
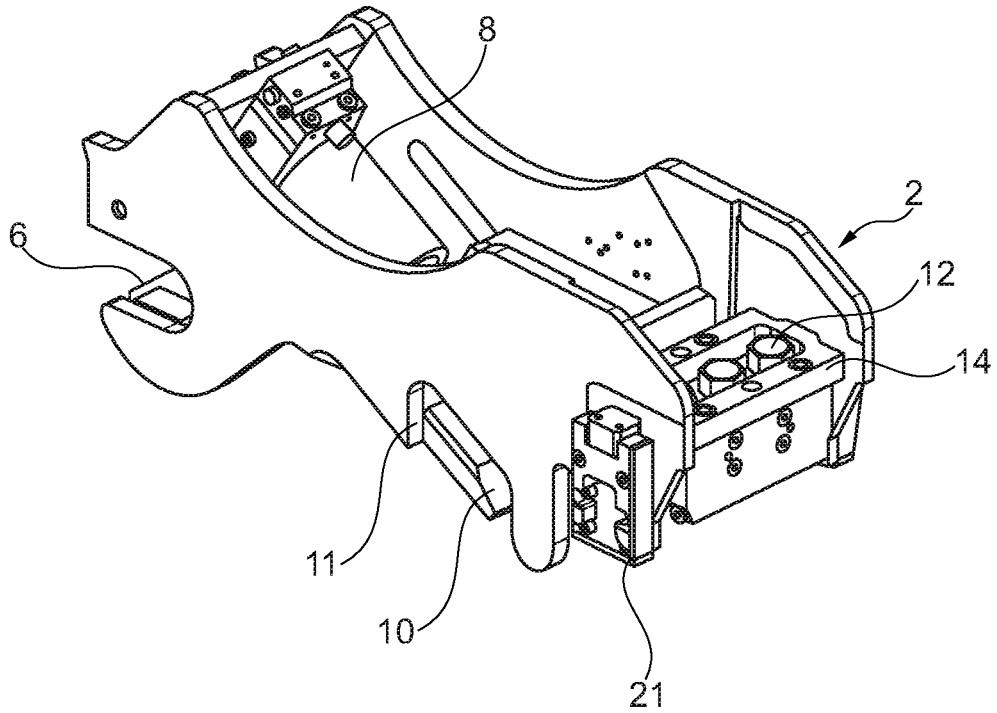
FIGS. 3A and 3B are each a perspective view of the two hitch halves, showing energy coupling parts attached to each hitch half, wherein partial view
Figure 3B:
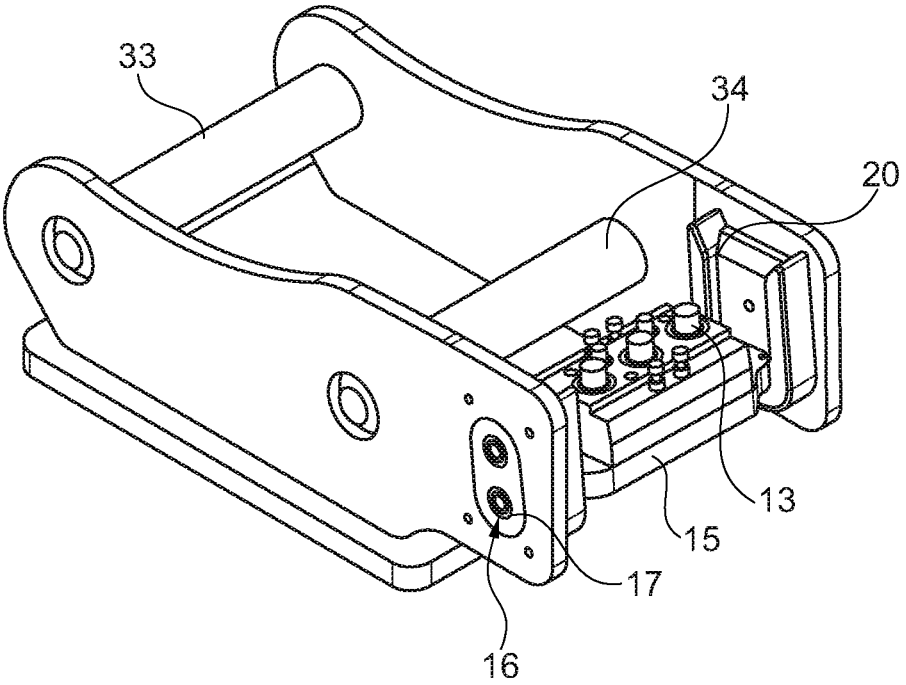

As shown in FIG. 2, the two hitch halves 2 and 3 comprise two pairs of latching parts that can be latched together and that allow for a two-stage coupling or latching process. Firstly, one pair of latching elements is hooked in or coupled, in order to then pivot the two hitch halves together about the coupled first latching pair. In the pivoted-together coupling position, the second pair of latching parts are then latched together, cf. a comparison of FIGS. 4 and 5.

As shown in FIG. 2, one hitch half, in particular the (arm-side) hitch half 2, can comprise, as latching parts, a coupling receptacle 6 and a latch 11 that can be moved in front of the opening of a latching receptacle 10, wherein the latching receptacle 10 can have a different opening direction from the coupling receptacle. In particular, the coupling receptacle 6 can be open in the direction facing away from the latching receptacle 10, while the latching receptacle 10 can be designed so as to be open towards the (tool-side) hitch half 3. However, as an alternative to the embodiment shown in the FIGS., according to FIG. 2, the second latching part of the hitch half 2 could also comprise a latching jaw that is displaceable as a whole, as is known per se. The latch 11 can be displaceable approximately in a direction transversely to the opening of the latching receptacle 10, in order to be able to be pushed in front of the opening. For example, the latch 11 can be moved into the latching receptacle 10 from above, so as to be slightly obliquely inclined.

The other hitch half, in particular the (tool-side) hitch half 3, can comprise two transverse bolts 33 and 34 as latching parts which can be oriented so as to be in parallel with one another and mutually spaced to such an extent that they fit into the openings of the coupling and latching receptacles 6 and 10.

In order to couple the two hitch halves 2 and 3 together, firstly the coupling receptacle 6 is suspended on the transverse bolt 33, wherein a securing element 7 can capture or secure the transverse bolt 33 in the coupling receptacle 6 in order to prevent the bolt from inadvertently slipping out when the two hitch halves 2 and 3 are pivoted together. The securing element 7 can for example be spring-preloaded and opened by a pressure actuator when the quick-hitch is intended to be decoupled.

Figure 4:
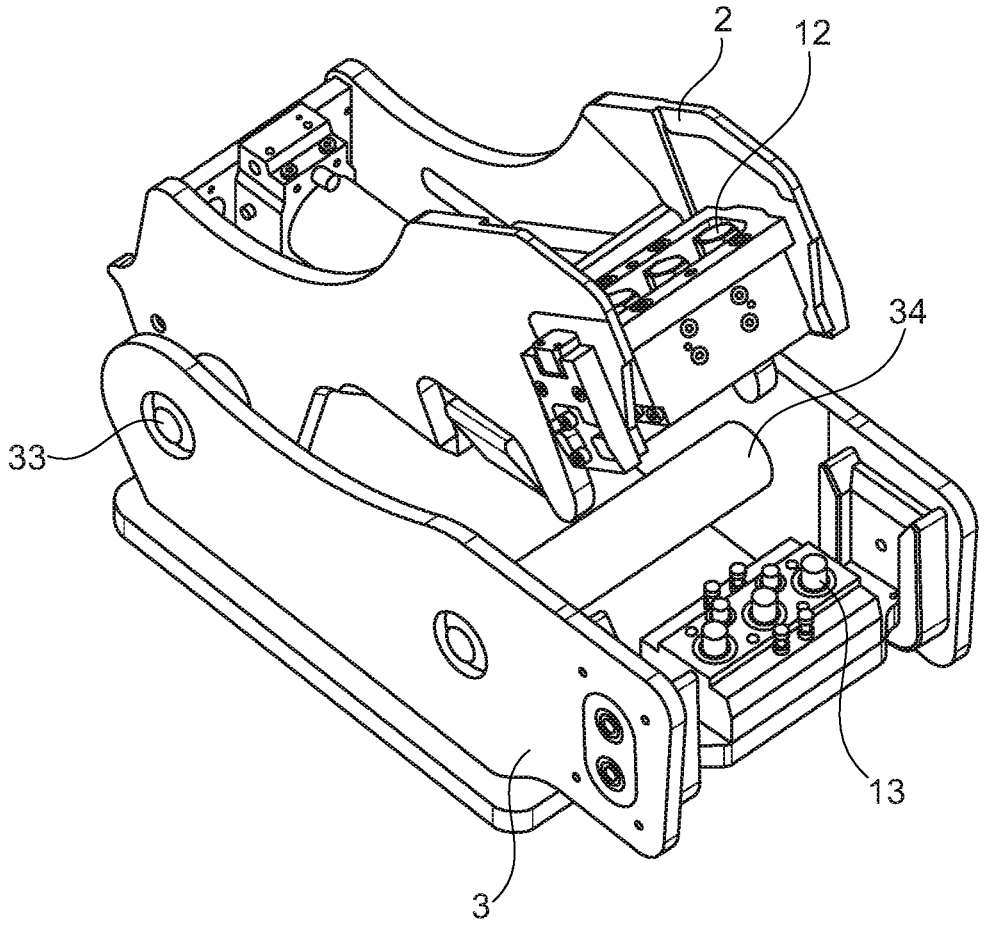
FIG. 4 is a perspective view of the two hitch halves in the state when coupled together but not yet pivoted together.
Figure 5:
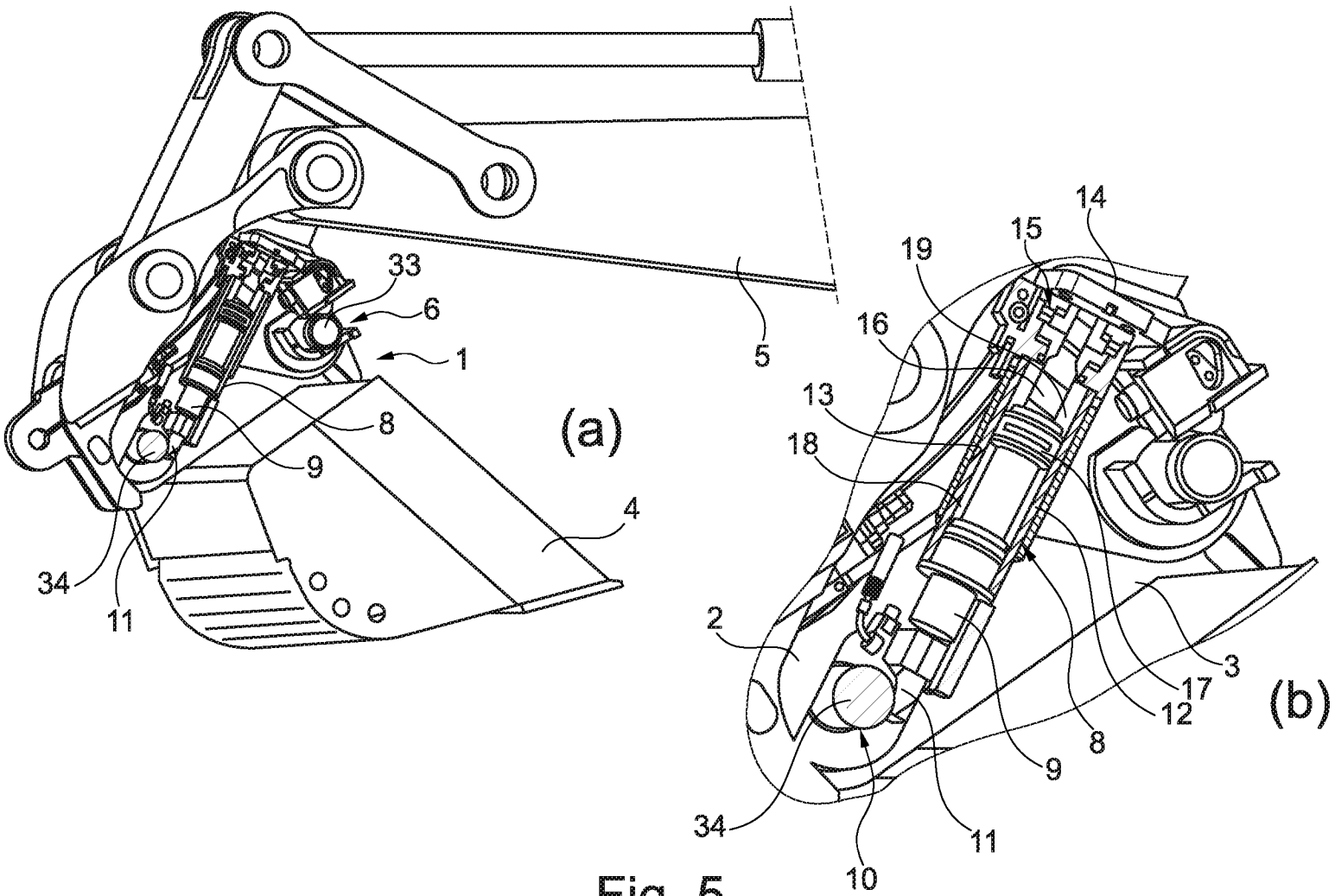
FIG. 5 is a perspective, partially cutaway view of the quick-hitch showing the arrangement of the actuating and locking cylinder for actuating the latch for the second latching bolt, wherein partial view a shows the actuating and locking cylinder in interaction with the quick-hitch halves and the grab bucket attached thereto, and partial view b is an enlarged, cutaway view of the actuating and locking cylinder.
Figure 6:
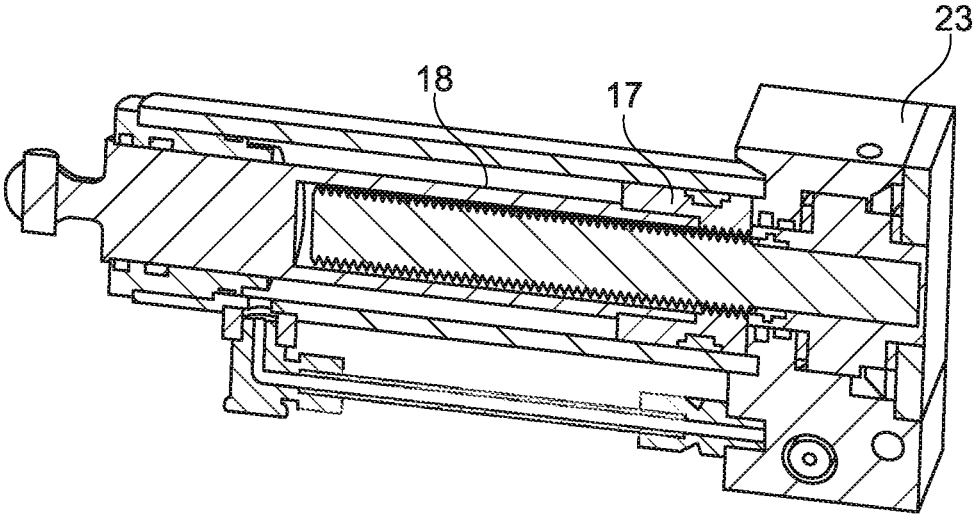
FIG. 6 is a perspective longitudinal sectional view of the actuating and locking cylinder of the preceding FIGS.

If the coupling receptacle 6 is suspended on the transverse bolt 33, as is shown in FIG. 4, the two hitch halves 2 and 3 can be pivoted towards one another about the pivot axis formed by the suspended coupling receptacle 6 or the transverse bolt 33 captured therein, as far as the coupling position shown in FIG. 5. In the mentioned coupling position according to FIG. 5, the second transverse bolt 34 is inserted into the latching receptacle 10 such that the latch 11 can be moved into the latching position in order to secure or fix the transverse bolt 34 in the latching receptacle 10. The latch 11 is actuated by actuating cylinder 8, being a pressure fluid cylinder 8, which will be discussed in further detail below.

As shown in FIGS. 4 and 5, energy coupling parts 12 and 13 can be provided on a portion of the hitch halves 2 and 3 that is spaced apart from the coupling receptacle 6, which energy coupling parts can in particular be arranged on an end portion of the hitch halves 2 and 3 that is opposite the coupling receptacle 6.

The energy coupling parts 12 and 13 can be hydraulic couplings for example. Irrespective thereof, the energy coupling parts 12 and 13 can be designed as plug-in couplings which can be moved into one another and can comprise coupling sleeves and coupling pins that can be inserted therein.

As FIG. 5 shows, it may be advantageous for the actuating cylinder 8 to be connected by its piston rod 9 to the latch 11 and to be supported and/or fixed to the hitch half 2 by its cylinder 12, from which the piston rod 9 is extractable. For example, the hitch half 2 may comprise the energy coupling part 13 comprising a receiving pocket 13 in which the energy coupling part 12 comprising a cylinder 12 is seated, wherein a support 14 may be provided at one end of the receiving pocket 13 against which the cylinder 12 may be axially supported. In principle, however, the actuating cylinder 8 could alternatively or additionally be bolted to the hitch half 2, for example, whilst a corresponding bearing eye could be provided on the cylinder 12.

As FIG. 5 shows, the actuating cylinder 8 may be inclined at an acute angle to a plane defined by the two coupling and latching receptacles 6 and 10, in particular transverse pin axes passing therethrough, so that the longitudinal axis of the actuating cylinder 8 passes on opposite sides of the coupling and latching receptacles 6 and 10. In particular, the actuating cylinder 8 may have an end portion positioned above the coupling receptacle 6, while the latch-side end of the cylinder 12 or the latch 11 may be positioned below the latching receptacle 10.

Overall, the actuating and locking cylinder 8 has a protected receptacle in an interior of the hitch half 2 and, in the coupled state of the quick-hitch 1, is enclosed by the outer peripheral contours or walls of the hitch halves 2 and 3 and is thereby protected. In particular, the lateral frame plates of the hitch halves 2 and 3 may laterally enclose the actuating cylinder 8.

As shown in FIGS. 5 to 8, a blocking or locking unit 15 is integrated into the actuating cylinder 8, which can fix the actuating cylinder 8 in one or more extension positions and, in particular, arrest the latch 11 in its latching position.

Figure 7:
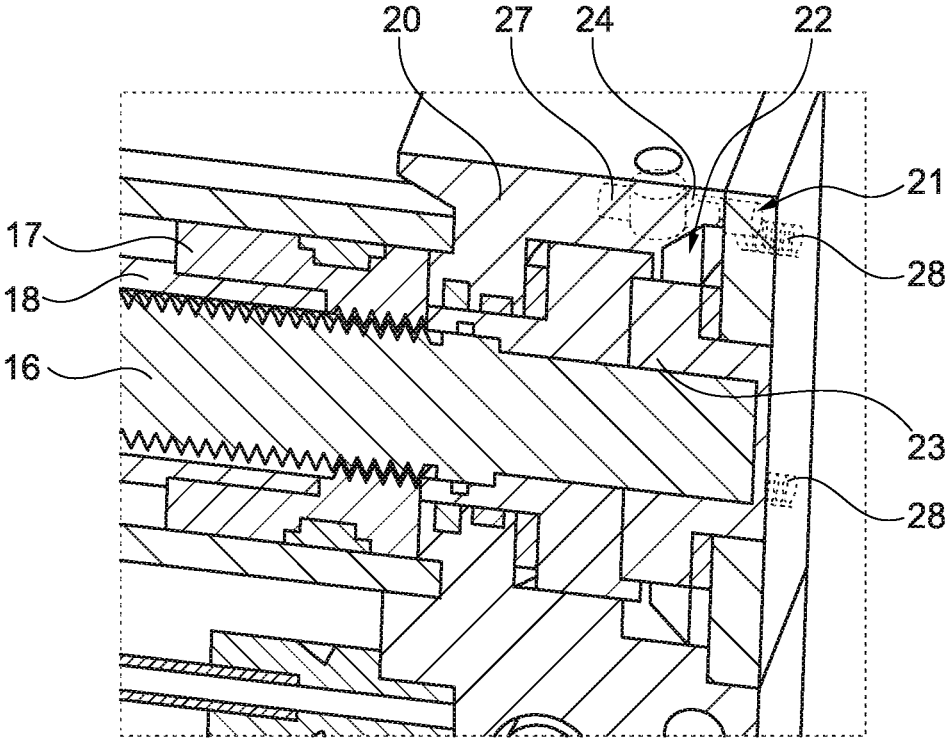
FIG. 7 is a partial, enlarged perspective longitudinal sectional view of the anti-rotation device for the lead screw of the actuating and locking cylinder.

In this respect, the blocking or locking unit 15 can comprise a mechanical blocking device 15 of the actuating cylinder 8 comprises a lead screw 16 which can be housed in the interior of the cylinder 12 and can be in threaded engagement with the piston 17 and/or the piston rod 9 of the actuating cylinder 8. For example, as FIG. 7 illustrates, the piston 17 may have an internal screw thread which is in screw engagement with an external thread of the lead screw 16 so that axial movement of the piston 17 involves rotation of the lead screw 16. The piston 17 is moved in the cylinder 12 in a manner known as such by pressurization, wherein the actuating cylinder 8 can advantageously be of double-acting design. Depending on whether the annular chamber 18 surrounding the piston rod 9 or the pressure chamber 19 facing away from the piston rod 9 is pressurized with pressure medium, the piston 17 retracts or extends. The piston 17 is guided in a non-rotatable manner, for example via the piston rod 9, which can be secured against rotation by its attachment to the latch 11 or also by the corresponding configuration of the outlet opening on the cylinder collar. Hereby an axial movement of the piston 17 leads to a rotation of the lead screw 16.

The lead screw 16 may be axially fixed but rotatably mounted in the cylinder 12, for example by means of a lead screw head 20 which may be non-rotatably connected to the lead screw 16 and rotatably mounted in the cylinder 12.

Due to the screw engagement between piston 17 and lead screw 16 and their bearings, piston 17 can only be moved axially if lead screw 16 can rotate. In order to lock the actuating cylinder 8, i.e. to freeze the piston 17 in its respective axial position, the lead screw 16 can be fixed against rotation by means of an anti-rotation device 21 which can block the rotational degree of freedom of the lead screw 16.

For this purpose, the anti-rotation device 21 comprises an anti-rotation element 22 which is also received in the cylinder 12 and is axially displaceable therein, but is rotationally fixed, so as to be brought into and out of latching engagement with the lead screw 16 or the lead screw head 20 connected thereto by axial displacement.

Figure 8:
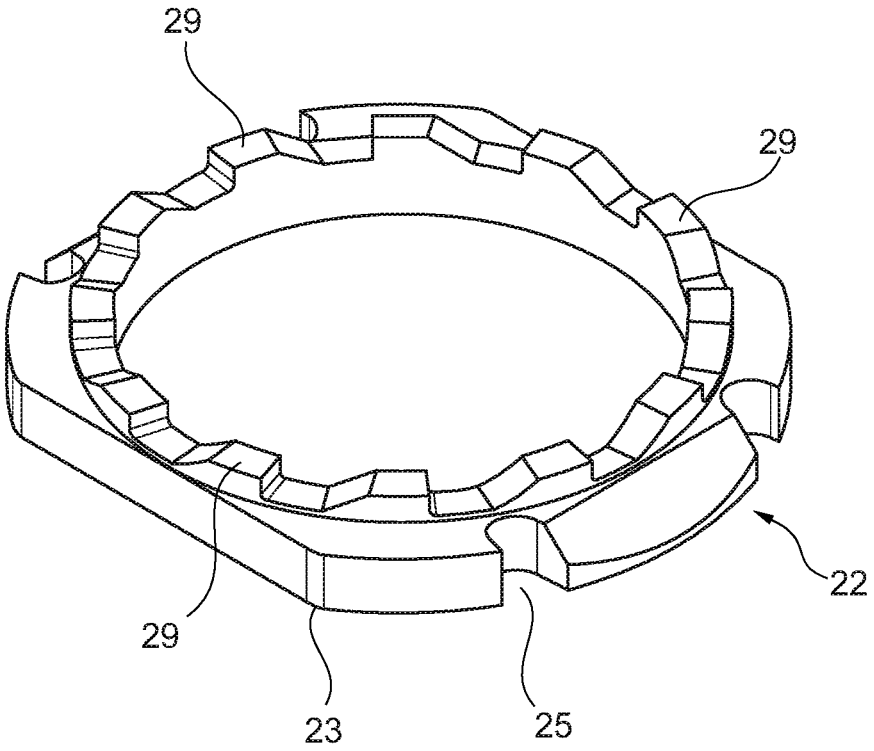
FIG. 8 is a perspective view of the anti-rotation element for locking the lead screw.

As FIG. 8 shows, the anti-rotation element 22 may advantageously comprise an at least approximately plate-shaped locking ring 23 which may embrace the lead screw head 20 and extend transversely to the longitudinal direction of the actuating cylinder.

In this regard, the locking ring 23 is axially slidably received in an installation space 24 which may form part of the cylinder 12. In order to secure the locking ring 23 against rotation, but to keep it axially displaceable, the locking ring 23 may have an outer contour deviating from the circular shape, for example by having one or more flattenings at the circumference and/or an overall oval and/or elliptical or polygon-like multi-angular design. In a corresponding manner, the installation space 24 may have an inner circumferential contouring deviating from the circular shape, for example having one or more flattenings and/or having an oval or elliptical or polygon-like multi-angular corresponding to the contouring of the locking ring.

Advantageously, the pairing of the outer and inner circumferential surfaces of the locking ring 23 and the installation space 24 simultaneously forms a displacement guide and an anti-rotation device, and in particular a (not circular) cylindrical contouring in the manner of a prism can be provided.

However, as an alternative or in addition to anti-rotation via the circumferential walls, separate longitudinal sliding guide elements could also be provided, for example in the form of longitudinal rods parallel to the longitudinal axis of the cylinder, which can engage in guide recesses 25 on the anti-rotation element 22, for example in the form of guide grooves open towards the outer circumference, as shown in FIG. 8.

The anti-rotation element 22, which may be in the form of the locking ring 23 shown, could in principle be axially adjusted by the application of pressure, a corresponding pressure chamber being formed by the installation space 24. Alternatively, however, separate displacement elements may be provided, for example in the form of plunger pistons, the displacement of which results in an axial displacement of the locking ring 23 or the anti-rotation element 22. For this purpose, for example, bores can be provided in a cylinder wall, in which the plunger pistons 27 are accommodated, so that they can be moved by pressurizing the bores in order to thereby axially displace the locking ring 23.

In this regard, the anti-rotation element 22 may be biased into the latching position by a preloading device, wherein the preloading device may comprise, for example, one or more spring means for urging the locking ring 23 axially into the latching blocking position by spring force.

In order to lock the threaded screw 16, provision can be made on the latching element and the lead screw head 20 for interlocking latching contours, in particular in the form of latching claws 29 and latching recesses adapted thereto in terms of shape, into which the latching claws 28 can retract. The latching claws 28 and the cooperating latching recesses may be provided on the locking ring 23 and the lead screw head 20, in particular projecting or machined in the axial direction. For example, provision can be made on the locking ring 23 for a plurality of axially projecting latching claws 28 distributed in the circumferential direction, which can enter latching recesses in an end face of the lead screw head 20 facing the locking ring 23.

As FIG. 8 shows, the latching contours can be configured to lock reliably on one side or in one direction only, wherein the latching claws 28 can have flanks which rise in a wedge shape towards one side and can thus be driven over, while locking flanks, for example perpendicular to the circumferential direction, can be provided on the opposite side. This makes it possible to continue turning the lead screw in one direction even when the locking ring 23 is actually preloaded into the latching position, wherein the latching connection continues slipping. In the opposite direction, however, the lead screw is reliably locked.

Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

I claim:

1. A quick-hitch comprising:

a first hitch half comprising a first latching part;

a second hitch half comprising a second latching part;

a latching element actuator configured to actuate a latching element between:

a latched position where the first hitch half and the second hitch half are latched together; and an unlatched position where the first hitch half and the second hitch half are unlatched; and a blocking device that, upon threadable activation, is configured to:

lock the latching element in the latched position; and block actuation of the latching element actuator;

wherein the blocking device comprises a lead screw in threaded engagement with one or more actuator parts of the latching element actuator;

a releasable anti-rotation device to lock at least one direction of rotation of the lead screw; and an adjusting device for axial adjustment of the releasable anti-rotation device;

wherein:

the adjusting device comprises a plunger piston received in a bore in a wall of the latching element actuator; and the plunger piston is adjustable by pressurization.

2. The quick-hitch of claim 1, wherein the one or more actuator parts are selected from the group consisting of a piston, a piston rod, and a combination thereof; and wherein the lead screw is placed into the threaded engagement with the one or more of the actuator parts so that each threadedly engaged actuator part is displaceable only by turning the lead screw.

3. The quick-hitch of claim 1, wherein the latching element comprises a bolt configured to be retractable and extractable from one or both of the first latching part and the second latching part by the latching element actuator.

4. The quick-hitch of claim 3, wherein the quick-hitch is configured to couple a tool to a tool manipulator.

5. The quick-hitch of claim 4, wherein either:

the releasable anti-rotation device is arranged within a cylinder of the latching element actuator, and the releasable anti-rotation device and the lead screw are mounted so as to be axially adjustable relative to each other and brought into and out of latching engagement by axial adjustment relative to each other; or the releasable anti-rotation device is mounted on the latching element actuator so as to be axially movable but rotationally fixed, and the lead screw is mounted in the latching element actuator so as to be rotatable but axially fixed.

6. A quick-hitch for coupling a tool to a tool manipulator comprising:

two hitch halves that are latchable to one another by a latching element comprising a bolt that is retractably and extractably associated with the two hitch halves, wherein a first hitch half of the two hitch halves comprises a first latching part and a second hitch half of the two hitch halves comprises a second latching part;

a latching element actuator comprising an actuating cylinder, the actuating cylinder configured to actuate the bolt between a latched position where the first hitch half and the second hitch half are latched together, and an unlatched position where the first hitch half and the second hitch half are unlatched;

a blocking device for locking the bolt in the latched position;

an adjusting device; and a releasable anti-rotation device;

wherein the actuating cylinder comprises a piston and a piston rod;

wherein the blocking device comprises a lead screw placed into threaded engagement with the piston and/or the piston rod of the actuating cylinder so that the piston can only be displaceable by turning the lead screw;

wherein the releasable anti-rotation device is configured to lock at least one direction of rotation of the lead screw;

wherein the adjusting device is for axial adjustment of the releasable anti-rotation device;

wherein the adjusting device comprises a plunger piston received in a bore in a cylinder wall of the actuating cylinder; and wherein the plunger piston is adjustable by pressurization.

7. The quick-hitch of claim 6, wherein the releasable anti-rotation device comprises a locking ring; and wherein the locking ring:

extends in a plane transverse to a longitudinal axis of a cylinder of the actuating cylinder;

is axially movable in a longitudinal direction of the actuating cylinder; and is fixed in rotation on the cylinder.

8. The quick-hitch of claim 6, wherein the releasable anti-rotation device is arranged within a cylinder of the actuating cylinder; and wherein the releasable anti-rotation device and the lead screw are mounted so as to be axially adjustable relative to each other and brought into and out of latching engagement by axial adjustment relative to each other.

9. The quick-hitch of claim 6, wherein the releasable anti-rotation device is mounted on the actuating cylinder so as to be axially movable but rotationally fixed; and wherein the lead screw is mounted in the actuating cylinder so as to be rotatable but axially fixed.

10. The quick-hitch of claim 6, wherein the releasable anti-rotation device is configured to lock on one side only in one direction of rotation.

11. The quick-hitch of claim 6 further comprising a preloading device for biasing the releasable anti-rotation device in a latching position where the bolt is in the latched position.

12. The quick-hitch of claim 6, wherein the actuating cylinder is accommodated in an interior space of the first hitch half and is enclosed by hitch walls when the first hitch half and the second hitch half are latched together.

13. The quick-hitch of claim 6, wherein the first hitch half further comprises a third latching part;

wherein the second hitch half further comprises a fourth latching part;

wherein the two hitch halves are couplable to each other at the third and fourth latching parts;

wherein the first and second latching parts are engageable and/or lockable by pivoting the two hitch halves together about the third and fourth latching parts; and wherein the bolt is associated with the first and second latching parts.

14. The quick-hitch of claim 6 further comprising two receiving jaws, a first receiving jaw of the receiving jaws being formed open to a side opposite to the other receiving jaw, being a second receiving jaw of the receiving jaws;

wherein the second receiving jaw is formed open in a circumferential direction on an arc around the first receiving jaw.

15. The quick-hitch of claim 7, wherein the locking ring has a circumferential contour deviating from a circular shape and is received in an installation space in an interior of the actuating cylinder; and wherein the actuating cylinder has an inner circumferential wall deviating from a circular shape and adapted in shape to the locking ring on which the locking ring is guided axially displaceably and is secured against rotation.

16. The quick-hitch of claim 7, wherein the locking ring comprises locking ring latching elements selected from the group consisting of latching claws, latching recesses, and combinations thereof, the locking ring latching elements distributed in a circumferential direction, which in the case of latching claws project towards the lead screw, and in the case of latching recesses are recessed away therefrom.

17. The quick-hitch of claim 11, wherein the preloading device comprises spring elements that act on the releasable anti-rotation device with axially acting spring forces.

18. The quick-hitch of claim 13, wherein the actuating cylinder is arranged at an acute angle inclined with respect to a plane defined by two pairs of latching parts, one pair being the first and second latching parts, and the other pair being the third and fourth latching parts; and wherein a longitudinal axis of the actuating cylinder passes opposite sides of the two pairs of latching parts.

19. The quick-hitch of claim 16, wherein the latching claws comprise a lock on one side and have latching flanks that are directed in a circumferential direction towards opposite sides and which are differently formed.

20. The quick-hitch of claim 19, wherein the latching flanks are perpendicular towards one circumferential direction and have flanks that rise in a wedge shape towards the opposite circumferential direction.

* * * * *